US005259866A

United States Patent [19]

Kobayashi et al.

[11] Patent Number: 5,259,866

[45] Date of Patent: Nov. 9, 1993

[54] METHOD FOR PRODUCING HIGH-PURITY METALLIC CHROMIUM

[75] Inventors: Kenichi Kobayashi, Yamagata; Tatsuhiko Fujinuma, Nihonbashi, both of Japan

[73] Assignee: Japan Metals & Chemicals Co., Ltd., Tokyo, Japan

[21] Appl. No.: 719,625

[22] Filed: Jun. 24, 1991

[51] Int. Cl.[5] ..... C22B 34/32

[52] U.S. Cl. ..... 75/623; 423/53; 423/59

[58] Field of Search ..... 75/623; 423/53, 59

[56] References Cited

U.S. PATENT DOCUMENTS

| | | | |
|---|---|---|---|
| 2,242,759 | 5/1941 | Schlecht et al. | 75/395 |
| 2,833,645 | 5/1958 | Erasmus | 75/623 |
| 2,890,952 | 6/1959 | Korpi et al. | 75/395 |
| 2,939,784 | 6/1960 | Brennan | 221/63 |
| 2,995,439 | 8/1961 | Litz | 75/623 |
| 3,158,464 | 11/1964 | Chynoweth | 75/623 |
| 3,271,139 | 9/1966 | Crago et al. | 75/623 |
| 3,502,461 | 3/1970 | Guttler et al. | 75/10.59 |
| 4,961,784 | 10/1990 | Tanabe et al. | 75/623 |
| 5,133,947 | 7/1992 | Stambaugh et al. | 423/55 |

FOREIGN PATENT DOCUMENTS

| | | |
|---|---|---|
| 283563 | 10/1990 | Japan . |
| 10363 | 1/1991 | Japan . |
| 10364 | 1/1991 | Japan . |

*Primary Examiner*—Donald P. Walsh
*Assistant Examiner*—Ngoclan T. Mai
*Attorney, Agent, or Firm*—Oliff & Berridge

[57] ABSTRACT

Chromium carbide powder and/or powder of an easily sulfidable metal are added to powdered crude metallic chromium to form a mixture thereof, which is then heated in vacuum to remove S, N and O by degassing so that consequently the crude metallic chromium is free from impurities to a possible maximum extent.

Alternatively, powdered crude metallic chromium is heated in an atmosphere of inert gas to temperature between 800 and 1,400° C. and then an easily sulfidable metal is added thereto to form a mixture thereof. Subsequently, the mixture is, directly or after adding carbon or chromium carbide, heated again in vacuum or in an atmosphere of inert gas to eliminate S, N and O by degassing so that the crude metallic chromium is free from impurities to a possible maximum extent.

Still alternatively, powdered crude metallic chromium is washed with inorganic acid such as hydrochloric acid, sulfuric acid or nitric acid or organic acid such as acetic acid to remove metal impurities such as Fe. The washed crude metallic chromium is then mixed with carbon or chromium carbide and the mixture is heated in vacuum or in an atmosphere of inert gas to eliminate S, N and O by degassing and consequently produce high-purity metallic chromium.

6 Claims, No Drawings

METHOD FOR PRODUCING HIGH-PURITY METALLIC CHROMIUM

BACKGROUND OF THE INVENTION

This invention relates to a method for producing high-purity metallic chromium and, particularly, it relates to a method for producing metallic chromium scarcely with low content level of impurities such as sulfur, nitrogen and oxygen. Metallic chromium with very low level of sulfur and oxygen contents produced by this newly proposed method provides a particularly advantageous material as chromium materials to be used in the fieled of the electronic industry and the fieled for producing the corrosion-resistive as well as heat-resistive alloys (super alloys).

Recently, metallic chromium has come to be popularly used for semi-conductors, electronic parts and dry plating. Metallic chromium containing gas such as oxygen and nitrogen at only very low level or metallic chromium with low sulfur content level is particularly advantageous for these applications.

Known methods for producing metallic chromium include the electrolytic method that decomposes $Cr_2(SO_4)_3$ by applying electricity and the thermite reduction method that reduces $Cr_2O_3$ by means of aluminum thermite reaction. However, metallic chromium by any of these known methods contains S, O, N at relatively high level and, therefore, is not good for electronic parts and super alloys, where highly pure metallic chromium is required as a constituent.

More specifically, the electrolytic method uses $Cr_2(SO_4)_3$ as electrolyte and, therefore, the resultant metallic chromium contains S at a relatively high level between 200 and 300 ppm, and contains O at a level between 3,000 and 5,000 ppm and N between 200 and 500 ppm due to the use of aqueous electrolyte.

On the other hand, metallic chromium obtained by the thermite reduction method contains S at a level as high as between 200 and 400 ppm because of the fact that sulfuric acid is used for deposition of $Cr_2O_3$ to be used as the source material and that almost all the sulfur contained in the source material remains in the resultant metallic chromium. While the O content can be decreased by increasing the rate of the reducing agent (aluminum) to be added to the source material, this in turn causes the aluminum to remain in the resultant metallic chromium at high content level. If the rate of the use of aluminum should be reduced, the O content of the obtained metallic chromium becomes inevitably as high as 3,000 to 4,000 ppm. The N content will be also as high as approximately 200 ppm.

Since metallic chromium produced by any of the known methods contains S, O and N at relatively high level, these impurities should be thoroughly removed from the metallic chromium if it be used for electronic parts and super alloys.

The vacuum carbon reduction method and the hydrogen reduction method are among the known methods for degassing metallic chromium.

With the vacuum carbon reduction method, carbon powder and, if necessary, an agglomeration agent are added to powdered crude metallic chromium and the mixture is then heated in vacuum to release the oxygen contained in the metallic chromium after turning it into CO. The hydrogen atmosphere reduction method is a method of degassing metallic chromium by heating powdered metallic chromium in an atmosphere of hydrogen and causing the oxygen contained in it to change to $H_2O$.

With the above described methods, where metallic chromium is heated either in vacuum, the resultant impurity content of the metallic chromium will be $S \leqq 50$ ppm for sulfur and $N \leqq 10$ ppm for nitrogen, which are by no means satisfactory for electronic parts and highly pure super alloys, where metallic chromium with a sulfur content level as low as $S \leqq 10$ ppm is required.

Besides, the vacuum reduction method that uses powdered carbon as deoxygenizing agent as described above has a disadvantage of consuming considerable time since the reduction to produce carbon monoxide takes place only after completion of the process of producing chromium carbide. It is also disadvantageous in that carbon powder and powdered crude metallic chromium can hardly be mixed evenly and, therefore, oxygen cannot be satisfactorily removed depending on the location of reaction, unprocessed carbon possibly remaining in the product.

Last but not least, the problem of safety and security is always involved in the method of hydrogen atmosphere reduction method because highly explosive hydrogen is heated to high temperature.

It is, therefore, an object of the present invention to provide a method for producing high-purity metallic chromium with low content level of impurities such as S, O and N safely and in a short period of time so that it may replace the above described carbon reduction method and hydrogen atmosphere reduction method.

Another object of the present invention is to provide a method for producing high-purity metallic chromium with low content level of impurities such as Fe, Ni and W.

SUMMARY OF THE INVENTION

According to a first aspect of the present invention, there is provided a vacuum reduction method for producing high-purity metallic chromium with low content level of impurities, wherein powder of an easily sulfidable metal such as Sn, Cu or Ni is added to crude metallic chromium powder and the mixture is heated in vacuum to produce metallic chromium with low content level of S, chromium carbide being added to said easily sulfidable metallic powder to remove O and N and lower the O, N content level of the resultant metallic chromium. (Alternatively, chromium carbide may be added to the crude metallic chromium powder in advance. In this case, easily sulfidable metallic powder is added to crude metallic chromium powder containing chromium carbide.)

In other words, according to the invention, there is provided a vacuum reduction method comprising a step of mixing crude metallic chromium powder, chromium carbide added thereto by an amount appropriate for supplying carbon to convert the oxygen contained in the crude metallic chromium powder to carbon monoxide and at least a metal selected from a group of metals including Sn, Cu and Ni added thereto by an amount appropriate for converting the sulfur contained in said crude metallic chromium powder to corresponding metal sulfide and a step of heating the mixture in vacuum at temperature between 1,100° and 1,500° C. to produce high-purity metallic chromium.

With a method as described above, the obtained metallic chromium contains impurities at very low level with evenly distributed oxygen and is, therefore, particularly suitable for applications that require low impurity content levels.

According to a second aspect of the invention, there is provided a vacuum reduction method for producing high-purity metallic chromium comprising a step of grinding crude metallic chromium, a step of washing the ground chromium with inorganic acid such as hydrochloric acid, sulfuric acid or nitric acid or organic acid such as acetic acid, a step of removing metallic impurities such as Fe and a subsequent step of adding either carbon or chromium carbide to the washed crude metallic chromium powder and powder of a metal selected from a group of easily sulfidable metals and heating the mixture in vacuum or in an atmosphere of inert gas at temperature between 1,100° and 1,500° C.

With a method as described above, the obtained metallic chromium contains impurities such as S, N and O and metallic impurities such as Fe at very low level and is, therefore, particularly suitable for applications that require low impurity content levels.

According to a third aspect of the invention, there is provided a method for producing high-purity metallic chromium comprising a step of heating crude metallic chromium at 800° to 1,400° C. in an atmosphere of inerts gas, a step of mixing the crude metallic chromium with an easily sulfidable metal and a step of heating the mixture at temperature between 1,100° and 1,500° C. in vacuum or in an atmosphere of inert gas.

According to a fourth aspect of the invention, there is provided a method for producing high-purity metallic chromium comprising a step of heating crude metallic chromium at 800° to 1,400° C. in an atmosphere of inert gas, a step of mixing the crude metallic chromium with an easily sulfidable metal and carbon or chromium carbide and a step of heating the mixture at temperature between 1,100° and 1,500° C. in vacuum or in an atmosphere of inert gas.

With a method as described above, sulfur contained in crude metallic chromium can be evenly and securely removed.

Chromium carbide to be used to remove oxygen contained in crude metallic chromium powder for the purpose of the present invention will preferably be $Cr_3C_2$, $Cr_7C_3$ or $Cr_{23}C_6$. Alternatively, metallic chromium containing chromium carbide expressed by any of these formulas may be used. In other words, chromium carbide may be replaced by metallic chromium containing chromium carbide for the purpose of the present invention.

The reason of the use of chromium carbide for the purpose of the present invention is that it is highly reactive as compared with powdered carbon and that the carbon contained in chromium carbide and the oxygen contained in crude metallic chromium powder as an impurity can be evenly mixed with each other. Consequently, the product will be free from the problem of unevenly distributed residual oxygen as well as that of highly reactive residual carbon. Besides, the time required for the overall reaction will be shorter than that of the case where powdered carbon is used.

DESCRIPTION OF THE PREFERRED EMBODIMENTS

Crude metallic chromium powder to be used for the purpose of the present invention will be that of 40 mesh or less. This is because finely powdered chromium can be brought to good contact with easily sulfidable metal so that they react well with each other.

Easily sulfidable metals that can be advantageously used for desulfurization for the purpose of the present invention include Sn, Ni and Cu. These metals easily react with sulfur to respectively produce SnS, NiS and CuS to reduce the sulfur content level of the crude metallic chromium powder with which they are mixed ($\leqq$10 ppm).

For mixing crude metallic chromium powder and powdered easily sulfidable metal, a binding agent such as PVA is added to the chromium powder firstly and subsequently the powdered easily sulfidable metal is added to it by a stoichiometric volume good for removing the sulfur content of the crude metallic chromium powder. In other words, the molecular ratio of the easily sulfidable metal to the sulfur in the chromium powder will be 0.5 to 2.0. If the amount of easily sulfidable metal is too small relative to the sulfur content, the residual sulfur can remain in the product to an undesirable degree and, if to the contrary the amount of easily sulfidable metal is too large, the unused sulfidable metal can remain in the product to affect its purity.

For mixing chromium carbide powder or powdered metallic chromium containing chromium carbide and crude metallic chromium powder, the former will be added to the latter by a stoichiometric volume good for reducing the oxygen in the crude metallic chromium powder to carbon monoxide. In other words, the molecular ratio of the carbon contained in the carbide to the oxygen contained in the crude metallic chromium powder will be 0.8 to 1.2.

The prepared mixture is then heated to temperature between 1,200° and 1,400° C. in vacuum. If the temperature is too low, the reaction will be significantly retarded, whereas Cr may be evaporated and lost when the temperature exceeds the specified range. The vacuum is preferably between 0.1 and 2 torr to maximize the effect of deoxygenization and denitrogenization.

It should be noted that crude metallic chromium prepared by means of the thermite reaction method and the electrolytic method is exposed to metal impurities such as Fe that can penetrate into it during the process of preparation. It is additionally exposed to metal impurities such as Fe, Ni and W during the subsequent grinding process to boost its impurity content level.

Since these metallic impurities cannot be removed through heating in vacuum, they remain in the final product.

With a method according to the second aspect of the present invention, however, the metal impurities including Fe contained in the prepared crude metallic chromium are removed during the step of washing the ground crude metallic chromium powder with inorganic acid such as hydrochloric acid, sulfuric acid or nitric acid or organic acid such as acetic acid.

Besides, the impurities such as S, N and O contained in the crude metallic chromium powder are gasified and removed from it while it is treated by heat in vacuum or in an atmosphere of inert gas. The process of treating the crude metallic chromium powder in vacuum, will be conducted in a manner similar to the corresponding process described above by referring to the first aspect of the invention.

Now, the third and fourth aspects of the invention will be described in greater detail.

As mentioned earlier, with the thermite reaction method for producing metallic chromium by reducing chromium oxide with aluminum, while the weight of oxygen that remains in the produced metallic chromium is a function of the ratio of the chromium oxide to the aluminum in the mixture, it can be significant whatever precautionary measures are taken to reduce the level of residual oxygen. Similarly, the crude metallic chromium can contain nitrogen and sulfur to a considerable extent.

With the electrolytic method for producing crude metallic chromium, the product normally contains oxygen, nitrogen and sulfur at a level higher than that of their counterparts in the product produced by means of the thermite reaction method.

While the sulfur contained as impurity in the prepared crude metallic chromium can be mostly removed by treating it by heat in vacuum as described above, this method of heat treatment can generate a condition where sulfur is unevenly distributed in the metallic chromium and the level of residual sulfur cannot be made lower than 10 ppm on stable basis. These and other problems often lead to production of metallic chromium with high level of sulfur content which does not show a satisfactorily high-purity.

A method according to the third aspect of the present invention eliminates these problems by preliminarily heat-treating crude metallic chromium at 800° to 1,400° C. in an atmosphere of inert gas before easily sulfidable metal is added thereto. With this method, it has been proved that the residual sulfur contained in the final product is evenly distributed throughout the product at a level lower than 10 ppm. When crude metallic chromium is preliminarily heat-treated, it seems, the sulfur atoms contained in it moves out of the crystalline particles of chromium into the granular chromium so that they may become free and readily react with easily sulfidable metal.

When the preliminarily heat-treated crude metallic chromium is ground, the sulfur in the granular chromium may be partly deposited on the surface of metallic chromium so that the reaction between the sulfur and the easily sulfidable metal may be accelerated. The heat-treatment is preferably conducted in vacuum or in an atmosphere of inert gas such as nitrogen or argon under normal atmospheric pressure.

Subsequent to the step of heat-treatment, the obtained crude metallic chromium powder is mixed with easily sulfidable metal and/or either carbon or carbide and heated to 1,100° to 1,500° C. in vacuum to produce high-purity metallic chromium with very low oxygen and sulfur content level. These steps are same as their counterparts as described earlier by referring to the first aspect of the invention.

EXAMPLE 1

Crude metallic chromium, obtained by aluminum-thermite reaction and having contents as listed in Table 1 and chromium carbide having contents as shown in Table 2 below were crushed into particles having a size equal to or less than 40 mesh. The two materials were then mixed together in such a manner that the weight of C contained in the chromium carbide showed an atomic ratio of 0.9 to the weight of oxygen contained in the crude metallic chromium. The mixture was then divided into three batches and Sn was added to the batches so that its weights in those batches showed atomic ratios of 0, 1.0 and 2.0 to the respective weights of S contained in them. The mixtures were then subjected to a heat-treatment in vacuum of 0.2 torr at 1,350° C. for four hours. Obviously, the mixing having a S:Sn atomic ratio of 1:1 turned out after the heat-treatment to be high-purity metallic chromium containing S at a level lower than 10 ppm. On the other hand, excessive Sn in one of the mixtures remained in the produced metallic chromium after the heat-treatment. It was found that the obtained metallic chromium was substantially free from O as it was removed from there by the added chromium carbide. It was also found that the nitrogen content of the obtained metallic chromium was negligible as a result of the heat-treatment in vacuum.

TABLE 1

| | Sn | C | S | O | N | Fe | (ppm) Si |
|---|---|---|---|---|---|---|---|
| Thermite product | <5 | 130 | 245 | 5300 | 472 | 450 | 202 |

TABLE 2

| | C | Fe | (wt %) Si |
|---|---|---|---|
| Chromium carbide | 9.6 | 0.29 | 0.12 |

TABLE 3

| | Sn | C | S | O | N | Fe | (ppm) Si |
|---|---|---|---|---|---|---|---|
| S:Sn = 1:0 C:O = 0.9:1 | <1 | 95 | 120 | 330 | <10 | 530 | 240 |
| S:Sn = 1:0 C:O = 0.9:1 | 30 | 100 | 8 | 450 | <10 | 540 | 230 |
| S:Sn = 1:0 C:O = 0.9:1 | 264 | 110 | 3 | 470 | <10 | 535 | 250 |

EXAMPLE 2

Crude metallic chromium obtained by electrolysis of chrome alum and having contents as listed in Table 4 and metallic chromium containing chromium carbide with contents as shown in Table 5 were crushed to particles with a size below 40 mesh. The materials were then mixed together in such a manner that the overall weight of oxygen contained in both the crude metallic chromium and the metallic chromium containing chromium carbide showed an atomic ratio of 0.9 to the weight of carbon. Thereafter, Sn was added to the mixture so that its weights in the mixture showed an atomic ratio of 1.0 to the total weight of S contained in it. The mixture was then subjected to a heat-treatment in vacuum of 0.2 torr at 1,350° C. for four hours. Results shown in Table 6. It was found that the obtained metallic chromium contained S by less than 10 ppm, O by less than 240 ppm and N by less than 10 ppm.

TABLE 4

| contents | Sn | C | S | O | N | Fe | (ppm) Si |
|---|---|---|---|---|---|---|---|
| crude metallic chromium | <1 | 110 | 209 | 6300 | 32 | 1272 | 25 |

TABLE 5

| contents | Sn | C | S | O | N | Fe | (ppm) Si |
|---|---|---|---|---|---|---|---|
| metallic Cr containing Cr carbide | <1 | 3600 | 259 | 2850 | 200 | 200 | 60 |

TABLE 6

| | Sn | C | S | O | N | Fe | (ppm) Si |
|---|---|---|---|---|---|---|---|
| Sn:S = 1:1<br>O:C = 1:0.9 | 18 | 53 | 7 | 240 | <10 | 460 | 50 |

EXAMPLE 3

A 100 kg of crude metallic chromium containing impurities as shown in Table 7 was crushed in a ball mill to particles having an average diameter of 100 mesh. The crushed material was then immersed in nitric acid solution (concentration 25%) for 2 hours.

After washing the material with water, a 290 g of powdered chromium carbide and a 90 g of powdered Sn were added and mixed well. Then, the powder was briquetted by using binder and subjected to heat-treatment in vacuum at 1,350° C. to obtain metallic chromium. Table 7 shows the contents of the chromium in different stages.

TABLE 7

| | Sn | S | C | O | N | (ppm) Fe |
|---|---|---|---|---|---|---|
| crude metallic chromium | <5 | 240 | 120 | 5300 | 400 | 200 |
| crushed material | <5 | 240 | 120 | 5300 | 400 | 2800 |
| final product | <1 | 10 | 100 | 300 | 10 | 200 |

While the Fe content level in the crude metallic chromium of this example was initially 200 ppm, it rose to 2,800 ppm when the raw material was crushed. A portion of the obtained material retained the level of 2,800 ppm when it was subjected to heat-treatment without being washed with acid. On the other hand, the Fe level of the remaining material dramatically dropped to 200 ppm when it was washed with acid according to the invention.

The oxygen level also dropped due to the added chromium carbide. The sulfur level was as low as 10 ppm.

It is obvious from these observation that high-purity metallic chromium containing metal impurities such as Fe as well as other impurities such as S, N and O only at a very low level can be obtained by means of a method according to the invention.

EXAMPLE 4

Flaked crude metallic chromium (100 kg×3 batches) containing impurities as shown in Table 8 was preliminarily heat-treated in an argon atmosphere for two hours. The material was then crushed to particles having an average size of 100 mesh, to which powdered carbon and Sn powder (C=290 g, Sn=90 g) were added. After mixing well, the material was molded to briquettes, which were then subjected to heat-treatment in vacuum of 0.2 torr at 1,350° C. for four hours experiment along with the impurities contained in the material that did not undergo preliminary heat-treatment.

As shown in Table 8, the material that had been preliminarily heat-treated showed a S level lower than 100 ppm in very batch, whereas the S level of the material without preliminary heat-treatment ranged between 10 and 30 ppm.

TABLE 8

| | | S | C | O | (ppm) N |
|---|---|---|---|---|---|
| | crude metallic Cr | 245 | 40 | 3650 | 180 |
| product with | batch 1 | 4 | 46 | 98 | <10 |
| preliminary | batch 2 | 2 | 52 | 85 | <10 |
| heat-treatment | batch 3 | 2 | 44 | 98 | <10 |
| product without | batch 4 | 10 | 50 | 93 | 12 |
| preliminary | batch 5 | 27 | 47 | 102 | 21 |
| heat-treatment | batch 6 | 13 | 60 | 90 | <10 |

EFFECTS

As is apparent from the above description, a method according to the present invention can produce high-purity metallic chromium impurities such as S, O and N only at a very low level in short period of time on stable basis. Such metallic chromium can be advantageously used for the electronic industry and for corrosion-resistive and heat-resistive super alloys.

Metallic chromium produced by a method according to the invention can effectively eliminate metal impurities such as Fe as well as other impurities, particularly sulfur.

What is claimed is:

1. A method for producing high-purity metallic chromium by removing impurities from crude metallic chromium, comprising steps of;

mixing crude metallic chromium powder, chromium carbide in an amount effective for supplying carbon to convert oxygen contained in the crude metallic chromium powder to carbon monoxide and an easily sulfidable metal in an amount effective for converting sulfur contained in said crude metallic chromium powder to corresponding metal sulfide; and heating the mixture in vacuum at a temperature between 1,100° and 1,500° C.

2. A method for producing high-purity metallic chromium by removing impurities from crude metallic chromium containing impurities, comprising:

a step of washing the crude metallic chromium powder with inorganic or organic acid, subsequently adding to the crude metallic chromium powder, a member selected from a group consisting of (a) either carbon or chromium carbide by an amount necessary to convert oxygen contained in said crude metallic chromium powder to carbon monoxide and (b) an easily sulfidable metal to form a mixture thereof and heating the mixture in vacuum or in an atmosphere of inert gas at temperature between 1,100° and 1,500° C.

3. A method for producing high-purity metallic chromium by removing impurities from crude metallic chromium containing impurities, comprising steps of heating the crude metallic chromium at 800° to 1,400° C. in an atmosphere of inert gas;

mixing the crude metallic chromium powder with an easily sulfidable metal; and heating the mixture at temperature between 1,100° and 1,500° C. in vacuum or in an atmosphere of inert gas.

4. A method for producing high-purity metallic chromium by removing impurities from crude metallic chromium containing impurities, comprising steps of heating the crude metallic chromium at 800° to 1,400° C. in an atmosphere of inert gas;

mixing the crude metallic chromium powder with an easily sulfidable metal and at least either carbon or chromium carbide by an amount necessary to convert oxygen contained in said crude metallic chromium powder to carbon monoxide; and heating the mixture in vacuum or in an atmosphere of inert gas at temperature between 1,100° and 1,500° C.

5. A method for producing high-purity metallic chromium according to claim 1, wherein the crude metallic chromium is ground to particles with a size equal to or smaller than 40 mesh.

6. A method for producing high-purity metallic chromium according to claim 1, wherein said easily sulfidable metal is Sn, Ni or Cu.

* * * * *